US012692664B2

(12) United States Patent
Heiskanen et al.

(10) Patent No.: US 12,692,664 B2
(45) Date of Patent: Jul. 28, 2026

(54) MULTI-PLY LINER FOR USE IN CORRUGATED BOARD

(71) Applicant: Stora Enso OYJ, Helsinki (FI)

(72) Inventors: Isto Heiskanen, Imatra (FI); Jukka Kankkunen, Imatra (FI); Ismo Saarinen, Lappeenranta (FI); Jukka Lyyra, Jämsä (FI); Juha Rvenniemi, Oriniemi (FI); Harri Taipale, Vantaa (FI); Hannu Heikkinen, Helsinki (FI)

(73) Assignee: Stora Enso OYJ, Helsinki (FI)

( * ) Notice: Subject to any disclaimer, the term of this patent is extended or adjusted under 35 U.S.C. 154(b) by 144 days.

(21) Appl. No.: 18/561,430

(22) PCT Filed: May 13, 2022

(86) PCT No.: PCT/IB2022/054482
§ 371 (c)(1),
(2) Date: Nov. 16, 2023

(87) PCT Pub. No.: WO2022/243822
PCT Pub. Date: Nov. 24, 2022

(65) Prior Publication Data

US 2024/0263401 A1 Aug. 8, 2024

(30) Foreign Application Priority Data

May 17, 2021 (SE) ..... 2150625-8

(51) Int. Cl.

| | |
|---|---|
| ***D21H 27/38*** | (2006.01) |
| ***D21F 11/12*** | (2006.01) |
| ***D21H 11/04*** | (2006.01) |
| ***D21H 11/06*** | (2006.01) |
| ***D21H 11/14*** | (2006.01) |
| ***D21H 21/16*** | (2006.01) |
| ***D21H 27/40*** | (2006.01) |

(52) U.S. Cl.
CPC ..... *D21H 27/40* (2013.01); *D21F 11/12* (2013.01); *D21H 11/04* (2013.01); *D21H 11/06* (2013.01); *D21H 11/14* (2013.01); *D21H 21/16* (2013.01); *D21H 27/38* (2013.01)

(58) Field of Classification Search
CPC ..... D21H 27/40; D21H 11/04; D21H 11/06; D21H 11/14; D21H 21/16; D21H 27/38; D21H 11/10; D21H 27/10; D21H 27/30; D21F 11/12
See application file for complete search history.

(56) References Cited

U.S. PATENT DOCUMENTS

| | | | | |
|---|---|---|---|---|
| 5,503,710 | A | 4/1996 | Horng | |
| 6,833,055 | B2 * | 12/2004 | Hansen | D21F 9/02 229/940 |
| 7,998,314 | B2 * | 8/2011 | Koch | D21H 21/10 162/158 |
| 11,299,853 | B2 | 4/2022 | Hoglund et al. | |
| 12,053,964 | B2 | 8/2024 | Lampainen et al. | |
| 2004/0069428 | A1 * | 4/2004 | Hansen | B32B 29/00 162/123 |
| 2010/0000693 | A1 | 1/2010 | Champ et al. | |
| 2017/0327285 | A1 | 11/2017 | Nordstrom | |
| 2019/0218716 | A1 | 7/2019 | Hoglund et al. | |
| 2024/0240408 | A1 * | 7/2024 | Heiskanen | D21H 21/16 |
| 2024/0263401 | A1 * | 8/2024 | Heiskanen | D21H 21/16 |

FOREIGN PATENT DOCUMENTS

| | | | | |
|---|---|---|---|---|
| CN | 109715882 | A | 5/2019 | |
| CN | 112543702 | A | 3/2021 | |
| CN | 117321265 | A * | 12/2023 | D21H 11/02 |
| CN | 119487259 | A * | 2/2025 | D21H 27/38 |
| EP | 0219643 | A1 | 4/1987 | |
| EP | 4589068 | A1 * | 7/2025 | D21H 27/40 |
| EP | 3516110 | B1 * | 8/2025 | D21H 11/10 |
| JP | 2024519008 | A * | 5/2024 | D21H 27/10 |
| JP | 2025522869 | A * | 7/2025 | |
| RU | 1810419 | C | 4/1993 | |
| RU | 2802868 | C2 * | 9/2023 | |
| SE | 1850798 | A1 | 1/2020 | |
| SE | 1850799 | A1 | 1/2020 | |
| SE | 2150622 | A1 * | 11/2022 | D21H 27/38 |
| SE | 2230218 | A1 * | 1/2024 | D21F 11/04 |
| SE | 545923 | C2 * | 3/2024 | D21F 11/04 |
| WO | WO-2020003128 | A1 * | 1/2020 | D21H 17/44 |
| WO | WO-2022243822 | A1 * | 11/2022 | D21H 27/40 |
| WO | WO-2024009175 | A1 * | 1/2024 | D21F 11/04 |

OTHER PUBLICATIONS

International Search Report from corresponding PCT application No. PCT/IB2022/054482, mailed Jul. 1, 2022.
Kirwan, Mark J., Paper and Paperboard Packaging Technology, Blackwell Publishing, 2005.
Ali, S.A., Design of multilayer paperboard for optimised compression strength, Karlstad University, Faculty of Health, Science and Technology, 2020, 51 pages, DiVA, id: diva2:1414179; whole document.
Zhong Wang et al., Massion Pine and Eucalyptus Urophylle, The Raw Materials for Draft Linerboard and Cardboard, China Pulp & Paper, No. 3, Jun. 30, 1994.

(Continued)

*Primary Examiner* — Jose A Fortuna

(74) *Attorney, Agent, or Firm* — Greer, Burns & Crain, Ltd.

(57) ABSTRACT

The present invention relates to a multi-ply liner for use in corrugated board, said multi-ply liner comprising: a first ply, and a second ply, wherein said first ply comprises at least 70 wt % unbleached kraft pulp and between 5-30 wt % neutral sulfite semi chemical (NSSC) pulp based on dry weight, and wherein said second ply comprises at least 50 wt % NSSC pulp and between 5-50 wt % unbleached kraft pulp based on dry weight.

12 Claims, No Drawings

(56) References Cited

OTHER PUBLICATIONS

Chinese Office Action from corresponding Chinese application No. 202280035489.9, issued Mar. 7, 2025.

Extended European Search Report from corresponding European application No. 22804143.0 dated Mar. 11, 2025.

Andrea Andrade et al., Eucalyptus globulus bark valorization: Production of fibers by Neutral Sulphite Semi-Chemical Process for Liner Paper Manufacture, Floresta e Ambiente 2021; 28(2): e20200048.

Man Mohan Singh et al., Liner Grade Pulp from Eucalyptus hybrid, Ippta, vol. XVI, No. 4, Dec. 1979.

Miguel Angel Pereira et al., Effect of sodium sulfite charge in NSSC pulping of E. globulus, Maderas. Ciencia y technologia 2011, 13(2): 225-234.

R.A. Solov'eva et al., Mathematical Models for Qualitative Properties of Packaging Board, Bumazh. Prom. No. 9: 14-15, Sep. 1987. (abstract only).

* cited by examiner

MULTI-PLY LINER FOR USE IN CORRUGATED BOARD

This application is a U.S. National Phase under 35 U.S.C. § 371 of International Application No. PCT/IB2022/054482, filed May 13, 2022, which claims priority under 35 U.S.C. §§ 119 and 365 to Swedish Application No. 2150625-8 filed May 17, 2021.

TECHNICAL FIELD

The present invention relates to a multi-ply liner for use in corrugated board, said multi-ply liner comprising NSSC pulp.

BACKGROUND

Corrugated board (sometimes referred to as corrugated cardboard or corrugated fiberboard) is a packaging material which can be converted to different types of packaging solutions. Corrugated board is a fiber based material made from cellulose fibers. The fibers can be virgin fibers or recycled fibers, such as fibers from used corrugated cardboard or other materials.

The corrugated board comprises at least one corrugated medium (fluting) and at least one non-corrugated medium (liner or linerboard) glued onto a surface of the corrugated medium. For example, the corrugated board may consist of a layer of fluting glued between two layers of liner to form a sandwich structure. The sandwich structure can be formed in different ways such as in single, double, and triple walls as described, e.g., in Kirwan M., J., Paper and Paperboard. Packaging Technology, Blackwell Publishing 2005.

One difficulty when producing corrugated board is the adhesion of the liner to the fluting. Too low adhesion causes delamination and addition of too much adhesive to ensure that the adhesion is sufficient can cause washboarding and curl of the corrugated board. It is important that the adsorption of the added glue into the liner and/or corrugated medium is optimal. If the adhesive is not adsorbed by the fluting/liner delamination will occur and the same will happen if it is adsorbed too much into the fluting/liner.

There are different kinds of corrugated board qualities, and these may comprise different types of liners and corrugated media. Containerboard (also known as CCM or corrugated case material) is a type of paperboard specially manufactured for the production of corrugated board. It includes both linerboard and corrugating medium (or fluting), the two types of paper that make up corrugated board. Since containerboard is made mainly out of natural unbleached wood fibers, it is generally brown, although its shade may vary depending on the type of wood, pulping process, recycling rate and impurities content.

Examples of different types of liners are kraftliner and testliner. Kraftliner is typically produced from kraft pulp that can be bleached or unbleached and may comprise one or more layers/plies wherein the top layer/ply is often optimized to provide a good printing surface and good moisture resistance. Testliner is mainly produced from recycled corrugated board and is commonly manufactured in two layers/plies. Due to the presence of recycled fibers, testliner may typically have lower mechanical strength, particularly lower burst strength, than kraftliner. Kraftliner is frequently used in packaging boxes with higher demands on strength properties.

Fluting is formed from paper or paperboard which has been corrugated using heat, moisture and pressure using a corrugator.

Fluting is often prepared from neutral sulfite semi chemical (NSSC) pulp. NSSC pulp, which is normally made from hardwood species, is noted for exceptional stiffness and high rigidity making it suitable for use in fluting. Neutral Sulfite Semi-Chemical (NSSC) pulping is an old process that it is well known in the field of paper pulping. One of the reasons for using NSSC pulping is the high yield, typically above 60%. In NSSC pulping, the cooking liquor comprises sulfite, such as $Na_2SO_3$ or $(NH_4)_2SO_3$ and a base, such as NaOH or $Na_2CO_3$. "Neutral" means that the pH of the NSSC cooking liquor is generally between 6 and 10. The pulp can be cooked in a batch or continuous cooker. Normally, the cooking time is between 5 minutes and 3 hours and the cooking temperature is 160-200° C. The NSSC pulp comprises comparatively high amounts of residual lignin, such as 15-20%, which makes the NSSC pulp stiff. The Kappa number of the NSSC pulp is typically above 70. The NSSC pulping is "semi-chemical" in the sense that it also comprises mechanical refining of the pulp. Refining may for example be done using a disc refiner at digester pressure or at atmospheric pressure.

Currently, strength and mechanical properties of fluting and corrugating medium are improved by adding small amounts of chemical pulp to mechanical pulps. Typically, 5-15% chemical pulp is added. This of course adds costs but also leads to reduced dewatering speed. One potential route is to mix semi-chemical pulp such as NSSC with unbleached kraft pulp, although this may lead to undesired optical mottle and variations in shade, as well as variations in organoleptic properties.

The fluting and liner(s) are attached to each other by arranging an adhesive between the corrugated medium and liner(s). The liner is attached to at least one surface of the corrugated medium by the adhesive. The adhesive is preferably applied on a least one surface of the fluted corrugated medium and the liner is thereafter attached to said surface. Any conventional adhesives in the area may be used. The adhesive may for example be a glue that is based on starch that can be extracted from a wide variety of plants. Some of the most common plants are maize, wheat, barley, rice, potato, tapioca and peas. The starch is preferably native, i.e., no modification of the starch has been done. The adhesive may also comprise water, sodium hydroxide and boric acid. Other additives, such as additives to improve the wet strength or adhesive bond strength may also be added. Also, other functional chemicals to improve e.g. moisture resistance or gelling behavior can be added, e.g., borax, glyoxal or mixtures thereof.

One important challenge when making corrugated medium and corrugated board is the resistance to humidity. When the corrugated board is exposed to humidity, water and water vapor may diffuse through the liners and soften the corrugating medium. A common solution to this problem is to increase grammage of the fluting and/or liner, but this is in conflict with environmental demands requiring lower grammage materials consuming less raw material.

Another solution is to provide a barrier layer on the liner to reduce the penetration of water and water vapor. However, this is only a partial solution since moisture diffusion may still occur on the opposite side or via the edges and consequently impact the mechanical stability of the corrugated board. Barrier layers also increase cost and typically reduce recyclability of the materials.

The fluting or corrugating medium may also be treated with hydrophobizing chemicals or coated, but this generally adds costs and may also impact the mechanical properties of the fluting negatively. High levels of hydrophobizing chemicals may also compromise the adhesion between the fluting and the liner(s). Particularly, NSSC pulps require high levels of hydrophobizing chemicals to obtain a required level of water resistance in the finished fluting.

New machine concepts and increased machine speeds, combined with increased demands for source reduction, has further increased the need for pulps with improved properties.

There remains a need for new and improved liner materials that combine strength, low grammage, water/moisture resistance, low chemical consumption, low cost, and/or high recyclability.

DESCRIPTION OF THE INVENTION

It is an object of the present disclosure to provide an improved liner for use in corrugated board, which solves or ameliorates at least some of the above mentioned problems.

It is a further object of the present disclosure to provide a liner for use in corrugated board, which comprises a high amount of NSSC pulp, but still exhibits good appearance and optical properties.

It is a further object of the present disclosure to provide a method for manufacturing a liner for use in corrugated board, which can reduce consumption of unbleached kraft pulp (UBKP) without losing the mechanical and or optical properties of a UBKP liner when used in a corrugated board.

The above-mentioned objects, as well as other objects as will be realized by the skilled person in the light of the present disclosure, are achieved by the various aspects of the present disclosure.

NSSC pulp is commonly used in fluting for corrugated board, but due to its optical and mechanical properties it is not used to the same extent in linerboard.

The present invention is based on the inventive realization that a liner having a high content of NSSC pulp for use in corrugated board can be embodied in the form of a multi-ply liner, wherein a first ply, intended as the top or print layer is comprised mainly of unbleached kraft pulp (UBKP), and a second ply, intended as the back ply facing the fluting in the corrugated board, comprises a high content of NSSC pulp. The addition of NSSC in the second ply can improve the strength of the liner, especially in liners comprising high amounts of recycled fibers (e.g. testliner). The NSSC in the second ply also reduces the consumption of the more expensive UBKP, thereby reducing the cost of the liner. Using NSSC in the second ply allows for high amounts of NSSC, even low grade or coarse NSSC, to be used without leading to undesired optical mottle and variations in shade of the liner, since the second layer is concealed by the UBKP-based first ply. Placing the NSSC pulp in the second ply allows for a much higher overall NSSC content in the liner than when the NSSC is mixed with UBKP in a single ply liner or in all plies of a multiply liner.

According to a first aspect illustrated herein, there is provided multi-ply liner for use in corrugated board, said multi-ply liner comprising:

a first ply, and a second ply, wherein said first ply comprises at least 70 wt % unbleached kraft pulp and between 5-30 wt % neutral sulfite semi chemical (NSSC) pulp based on dry weight, and wherein said second ply comprises at least 50 wt % NSSC pulp and between 5-50 wt % unbleached kraft pulp based on dry weight.

The liner of the present disclosure is a multi-ply liner comprising a first ply (also referred to as the top ply), and a second ply (also referred to as the back ply). The outer surfaces of the multi-ply liner, i.e. the surfaces of the top and back ply facing away from the other ply, are referred to as top side and back side respectively.

The liner can be manufactured in a paper or paperboard machine adapted for manufacturing of multi-ply liner. Paper or paperboard machines for making multi-ply liner are well known in the art. Typically, the machine layout comprises a stock handling section, a wet end section, a pressing and drying section and a calendering and/or coating section. In the wet end section, the plies of the multi-ply liner may be formed individually, using different headboxes and laminated in a wet state, or formed together using a multiply headbox. If formed individually, the plies are typically laminated, or couched together, before the press and drying section of the paper machine.

In some embodiments, the grammage of each of the first ply and the second ply is in the range of 20-150 g/m$^2$, preferably in the range of 30-100 g/m$^2$. The total grammage of the multi-ply liner is preferably in the range of 40-300 g/m$^2$.

The first ply of the multi-ply liner comprises at least 70 wt % unbleached kraft pulp (UBKP). In some embodiments, said first ply comprises at least 75 wt %, preferably at least 80 wt %, unbleached kraft pulp based on dry weight. The first ply may comprise comprises 95 wt % or less, 90 wt % or less, or 85 wt % or less, UBKP based on dry weight.

Unbleached kraft pulp, or UBKP, generally refers to an unbleached sulphate pulp based on pine and/or spruce. The main raw material of the UBKP is preferably pine, but it can also contain up to 45 wt % spruce. In some embodiments, the UBKP has a Kappa number above 55, preferably above 60, and more preferably above 70, as determined according to SCAN ISO C-1.

The first ply may further comprise NSSC pulp, but at a lower content than the second ply. The first ply comprises between 5-30 wt % NSSC pulp based on dry weight. Preferably, the first ply comprises between 5-20 wt % or between 5-10 wt % NSSC pulp based on dry weight.

The part of the first ply not being UBKP or NSSC pulp, may comprise any kind of fibers, such as hardwood and/or softwood fibers and may include, e.g., chemical pulp, mechanical pulp, thermomechanical pulp or chemi-thermo-mechanical pulp (CTMP). In some embodiments, the liner is a kraftliner, and the part of the first ply not being UBKP is made entirely from virgin fibers. The part of the first ply not being UBKP may also for example comprise recycled fibers. For example, the first ply of the present disclosure may consist essentially of UBKP or a mixture of UBKP and recycled fibers. "Recycled fibers" refers to fiber material that has previously been incorporated in some paper or board product. Alternatively, or as a complement, the part of the pulp not being UBKP may for example comprise reject pulp. For example, the pulp of the present disclosure may consist essentially of UBKP and reject pulp. "Reject pulp" refers to pulp prepared by refining the screen reject from another process.

In some embodiments, the first ply of the multi-ply liner is optimized to provide a good printing surface and good moisture resistance. In some embodiments, the optimization to provide a good printing surface and good moisture resistance includes surface sizing. In some embodiments the multi-ply liner is surface sized. In some embodiments the multi-ply liner is surface sized with starch. In some embodiments the multi-ply liner is surface sized with a combination of starch and at least one other functional component, preferably selected from the group consisting of a crosslinker, a reinforcing agent, and a hydrophobizing sizing agent. The crosslinker may for example be citric acid. The reinforcing agent may for example be microfibrillated cellulose (MFC). The hydrophobizing sizing agent may for example be alkyl ketene dimer (AKD), alkenyl succinic anhydride (ASA), SMA (Styrene Maleic Anhydride), a rosin size, or mixtures thereof.

The second ply comprises a significantly higher content of NSSC pulp than the first ply. The second ply comprises at least 50 wt % NSSC pulp based on dry weight. In some embodiments, said second ply comprises at least 60 wt %, preferably at least 70 wt %, more preferably at least 80 wt %, NSSC pulp based on dry weight. The second ply may comprise 95 wt % or less, 90 wt % or less, 85 wt % or less, 80 wt % or less, or 75 wt % or less, NSSC pulp, based on dry weight.

"NSSC pulp" is obtained from "NSSC pulping", which in turn is defined in the background section. The NSSC pulp can be hardwood pulp or softwood pulp, or a mixture thereof. The NSSC pulp is preferably hardwood pulp or a hardwood/softwood pulp mixture with less than 15 wt % softwood, preferably less than 10 wt % softwood, and more preferably less than 5 wt % softwood. The hardwood may for example be aspen, alder, poplar, eucalyptus, birch, acacia, or beech. The NSSC pulp is preferably prepared cooked using a cooking liquor comprising sulfite, preferably $Na_2SO_3$ or $(NH_4)_2SO_3$ and a base, preferably NaOH or $Na_2CO_3$. In some embodiments the yield from the NSSC pulping is above 60%, preferably above 65%, preferably above 70%, and more preferably above 75%. The term "neutral" means that the pH of the NSSC cooking liquor is in the range of 6-10. The cooking time preferably in the range of 5 minutes to 3 hours. The cooking temperature is preferably in the range of 160-200° C. The NSSC pulp may comprise comparatively high amounts of residual lignin, such as 15-20%. The Kappa number of the NSSC pulp is typically above 70, preferably above 80, preferably above 95, and more preferably above 100, according to ISO 3260. The NSSC pulping is "semi-chemical" in the sense that it also comprises mechanical refining of the pulp. Refining may for example be done using a disc refiner at digester pressure or at atmospheric pressure. The refining can be done in one or more steps at the same or different pulp consistencies. A first refining step may preferably be done at higher consistency such as 5-35%, and a second refining step may preferably be done at lower consistency <5%.

The second ply may also comprise UBKP, but the second ply comprises a significantly lower content of UBKP than the first ply. The second ply comprises between 5-50 wt % UBKP based on dry weight. Preferably, the second ply comprises between 5-40 wt %, between 5-30 wt %, or between 5-20 wt %, UBKP based on dry weight.

The part of the second ply not being NSSC pulp or UBKP, may comprise any kind of fibers, such as hardwood and/or softwood fibers and may include, e.g., chemical pulp, mechanical pulp, thermomechanical pulp or chemi-thermo-mechanical pulp (CTMP). In some embodiments, the liner is a kraftliner, and the part of the second ply not being NSSC pulp is made entirely from virgin fibers. The part of the second ply not being NSSC pulp may also for example comprise recycled fibers. For example, the second ply of the present disclosure may consist essentially of NSSC pulp or a mixture of NSSC pulp and recycled fibers. "Recycled fibers" refers to fiber material that has previously been incorporated in some paper or board product. Alternatively, or as a complement, the part of the pulp not being NSSC pulp may for example comprise reject pulp. For example, the pulp of the present disclosure may consist essentially of NSSC pulp and reject pulp. "Reject pulp" refers to pulp prepared by refining the screen reject from another process.

The addition of NSSC in the second ply can improve the strength of the liner, especially in multi-ply liners comprising high amounts of recycled fibers (e.g. testliner). In some embodiments, at least 30% of the second ply is made up of recycled cellulose fibers.

In some embodiments, the multi-ply liner further comprises a strengthening or adhesive agent applied at the interface between the first ply and the second ply. Preferably, this strengthening or adhesive agent comprises cooked or gelatinzed or uncooked starch, or a mixture of cooked or gelatinzed or uncooked starch with microfibrillated cellulose (MFC). A preferred strengthening or adhesive agent is cooked native starch or cooked native starch mixed with microfibrillated cellulose. In some embodiments, the strengthening or adhesive agent further comprises a crosslinker. The crosslinker may for example be citric acid. In some embodiments, the strengthening or adhesive agent further comprises an insolubilizer. The insolubilizer may for example be an amino resin, glyoxal, or zirconium salt insolubilizer. The amount of strengthening or adhesive agent applied at the interface between the second ply and the second ply is preferably in the range of 0.1-5 $g/m^2$, more preferably in the range of 0.5-3 $g/m^2$, based on dry weight.

Due to the high content of NSSC pulp in the second ply, the multi-ply liner overall has a high content of NSSC pulp. In some embodiments, the amount of NSSC pulp in the multi-ply liner is at least 10 wt %, preferably at least 20 wt %, more preferably at least 30 wt % based on dry weight. In some embodiments, the amount of NSSC pulp in the multi-ply liner is at least 40 wt %, preferably at least 50 wt %, more preferably at least 60 wt % based on dry weight.

In some embodiments, the NSSC pulp used in the multi-ply liner is a fractionated NSSC pulp. Fractionated NSSC pulp is obtained by size fractionation of an NSSC pulp starting material into a fine fiber fraction and a coarse fiber fraction. Compared to the starting material, the fine fiber fraction has a higher amount of shorter and thinner fibers. In other words, the average particle size of NSSC pulp of the fine fiber fraction is lower than the average particle size of the NSSC pulp of the coarse fiber fraction. The fine fiber fraction may for example be obtained by separating the NSSC pulp starting material in pressure screens to achieve a fraction with shorter and thinner fibers.

The fine fiber fraction obtained by size fractionation of an NSSC pulp is especially advantageous for use in the first ply of the multi-ply liner, intended as the top or print layer, since it has less effect on the optical properties of the liner as compared to an unfractionated or coarse fiber fraction of the NSSC pulp. The coarse fiber fraction may advantageously be used in the second ply, where it does not affect the optical properties of the liner. In a preferred embodiment, the NSSC pulp used in the first ply is the fine fiber fraction of a fractionated NSSC. In a preferred embodiment, the NSSC pulp used in the second ply is the coarse fraction of a fractionated NSSC pulp. In some embodiments, the average particle size of the NSSC pulp used in the first ply is lower than the average particle size of the NSSC pulp used in the second ply.

In some embodiments, said multi-ply liner further comprises an internal sizing agent. The internal sizing agent is preferably a hydrophobizing sizing agent. In some embodiments, the internal sizing agent is selected form the group consisting of alkyl ketene dimer (AKD), alkenyl succinic anhydride (ASA), rosin sizes, and mixtures thereof. In some embodiments, the amount of the internal sizing agent in the multi-ply liner is in the range of 0.5-6 kg/tn, preferably in the range of 0.8-4 kg/tn, and more preferably in the range of 1-3 kg/tn, based on dry weight.

In some embodiments, at least one side, preferably the top side, of the multi-ply liner has a Cobb 30 s value below 30, preferably below 25, and more preferably below 22, as determined according to standard ISO 535.

In some embodiments, said multi-ply liner has an equilibrium moisture content (EMC) of less than 10 wt %, preferably less than 8 wt % at 50% RH, as determined according to standard ISO 287.

The multi-ply liner may further exhibit one or more of the following physical properties:

Tensile Index GEOM (ISO 1924-3) is preferably higher than 65 Nm/g, preferably higher than 66 Nm/g, and more preferably higher than 67 Nm/g.

Tensile stiffness Index GEOM (ISO 1924-3) is preferably higher than 5.9 kNm/g, preferably higher than 6.0 kNm/g, and more preferably higher than 6.2 kNm/g.

Fracture toughness Index GEOM (ISO/TS 17958) is preferably higher than 8 Jm/kg, preferably higher than 8.5 Jm/kg, and more preferably higher than 9 Jm/kg.

SCT Index GEOM (ISO 9895) is preferably higher than 25 Nm/g and more preferably higher than 26 Nm/g.

Burst index (ISO 2759) is preferably at least 3 $kPam^2/g$, more preferably at least 3.2 $kPam^2/g$.

The multi-ply liner may further comprise additives such as native starch or starch derivatives, cellulose derivatives such as sodium carboxymethyl cellulose, a filler, retention and/or drainage chemicals, flocculation additives, deflocculating additives, dry strength additives, softeners, cross-linking aids, sizing chemicals, dyes and colorants, wet strength resins, fixation agents, de-foaming aids, microbe and slime control aids, or mixtures thereof.

The multi-ply liner may further comprise a third ply wherein said third ply comprises at least 70 wt % unbleached kraft pulp and between 5-30 wt %, preferably between 5-20 wt % or even more preferred between 5-10 wt % neutral sulfite semi chemical (NSSC) pulp based on dry weight. It is preferred that the third ply has the same composition as the first ply. I may be preferred that the first and third plies of the multi-ply liner will form the outer plies and the second ply form the mid-ply of the multiply liner.

In some embodiments it is preferred that the multi-ply liner is a 2-ply liner. The 2-ply liner comprises only two cellulose based plies, i.e. only said first and second plies.

The multi-ply liner is intended for use in corrugated board. Corrugated board comprises at least one layer of liner, which is non-corrugated, which is glued to at least one layer of fluting. For example, corrugated board may consist of a layer of fluting sandwiched between two layers of liner. According to a second aspect illustrated herein, there is provided a corrugated board comprising a multi-ply liner according to the first aspect and a fluting. In preferred embodiments, the fluting is glued to the second ply of the multi-ply liner.

According to a third aspect illustrated herein, there is provided a method for manufacturing a multi-ply liner for use in corrugated board, comprising the steps of:

a) forming a first web layer from a first pulp suspension and dewatering said first web layer to obtain a first ply;

b) forming a second web layer from a second pulp suspension and dewatering said second web layer to obtain a second ply on the first ply;

wherein said first pulp suspension comprises at least 70 wt % unbleached kraft pulp and between 5-30 wt % neutral sulfite semi chemical (NSSC) pulp based on dry weight, and wherein said second pulp suspension comprises at least 50 wt % NSSC pulp and between 5-50 wt % unbleached kraft pulp based on dry weight.

The terms first and second web layer do not necessarily denote the order in which the web layers are formed. The web layers can be formed simultaneously or individually, in any order.

In some embodiments, the first and second web layer are formed and partially dewatered individually, using different headboxes and one or more wires, and subsequently laminated in a wet state.

In some embodiments, the first and second web layer are formed and partially dewatered together using a multiply headbox and a single wire.

For example, the first web layer may be formed and partially dewatered individually, and subsequently laminated in a wet state with the second web layer to obtain a second ply on the first ply. Alternatively, the second web layer may be formed and dewatered together with the first web layer.

In some embodiments, said first pulp suspension comprises at least 75 wt %, preferably at least 80 wt %, unbleached kraft pulp based on dry weight.

In some embodiments, said first pulp suspension comprises between 5-20 wt %, preferably between 5-10 wt %, NSSC pulp based on dry weight.

In some embodiments, said second pulp suspension comprises at least 60 wt %, preferably at least 70 wt %, more preferably at least 80 wt %, NSSC pulp based on dry weight.

In some embodiments, at least 30% of the pulp of the second pulp suspension is made up of recycled cellulose fibers.

In some embodiments, the grammage of each of the first ply and the second ply is in the range of 20-150 $g/m^2$, preferably in the range of 30-100 $g/m^2$.

In some embodiments, the amount of NSSC pulp in the multi-ply liner is at least 10 wt %, preferably at least 20 wt %, more preferably at least 30 wt % based on dry weight.

In some embodiments, the average particle size of the NSSC pulp used in the first pulp suspension is lower than the average particle size of the NSSC pulp used in the second pulp suspension.

The method comprises forming and dewatering a number of webs from pulp suspensions. Methods for forming and dewatering webs having multiple layers are well known in the art. The liner can be manufactured in a paper or paperboard machine adapted for manufacturing of multi-ply liner. Paper or paperboard machines for making multi-ply liner are well known in the art. Typically, the machine layout comprises a stock handling section, a wet end section, a pressing and drying section and a calendering and/or coating section.

The webs are generally formed and dewatered in a formed in a wet end section, comprising one or more wires as conventional in the field. The plies may be formed individually, using different headboxes and laminated in a wet state, or formed together in a multiply headbox. The web is typically formed in a gap former, but it may also be formed in a fourdrinier type former. If formed individually, the wet plies are typically laminated, or couched together, before the press and drying section of the paper machine.

Before the lamination, a strengthening or adhesive agent can be applied between the first ply and the second ply. Preferably, this strengthening or adhesive agent comprises cooked or gelatinzed or uncooked starch, or a mixture of cooked or gelatinzed or uncooked starch with microfibrillated cellulose (MFC). A preferred strengthening or adhesive agent is cooked native starch or cooked native starch mixed with microfibrillated cellulose. In some embodiments, the strengthening or adhesive agent further comprises a crosslinker. The crosslinker may for example be citric acid. In some embodiments, the strengthening or adhesive agent further comprises an insolubilizer. The insolubilizer may for example be an amino resin, glyoxal, or zirconium salt insolubilizer. The strengthening or adhesive agent is preferably added as a paste or an aqueous dispersion using a non-contact deposition technique, such as spray or foam or curtain application. Preferably, the solid content of the aqueous dispersion is in the range of 0.5-50 wt %, and more preferably in the range of 1-30 wt %. The amount of strengthening or adhesive agent applied is preferably in the range of 0.1-5 g/m$^2$, more preferably in the range of 0.5-3 g/m$^2$, based on dry weight.

The web is typically subjected to further dewatering, which may for example include passing the formed multilayer web through a press section of the paper machine, where the web passes between large rolls loaded under high pressure to squeeze out as much water as possible. The press section may constitute of traditional nip press units and press fabric felts and/or with one or several shoe presses or extended dewatering nips. These can be run at various nip or press loads including different positions, temperatures and delays times. The press section may be provided with one or more shoe presses to maximize production. If using one or several shoe presses, these can be run at press levels above 800 kN/m, such as above 1000 kN/m, such as above 1200 kN/m, or such as such as above 1450 kN/m. The removed water is typically received by a fabric or felt.

After the press section, the multilayer web may be subjected to drying in a drying section. The drying may for example include drying the multilayer web by passing the multilayer web around a series of heated drying cylinders. Drying may typically remove the water content down to a level of about 1-15 wt %, preferably to about 2-10 wt %.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

EXAMPLES

These examples demonstrate that high amounts of NSSC pulp can be used in a 2-ply liner without negatively affecting mechanical or optical properties of the liner.

2-Ply Liner Preparation Method 2-ply linerboards comprising a front ply (corresponding to the first ply of the invention) and a back ply (corresponding to the second ply of the invention) were prepared on a pilot machine equipped with 2 headboxes and 2 wires, a press section, and a drying section. The target end moisture content for the 2-ply structures was 8.5 wt % and the target grammage was 120 g/m$^2$. The web was calendered online with a machine calender at 100° C. and a nip load of 45 KN/m.

The NSSC pulp, had a Lc(w) fiber length of 1.14 mm as determined by the FS5 ISO method. The FS5 curl was 2% and FS5 fibrillation 1.55%. The FS5 Fines A amount was 20.3%.

The unbleached kraft pulp was refined to SR 30. The corresponding fibers properties were: Lc(w) fiber length of 2.32 mm, FS5 curl of 6.8% and FS5 fibrillation 1.78%. The FS5 Fines A amount was 18.8%.

All pulp suspensions contained the same amounts of retention and drainage chemicals and strength and internal sizing chemicals (AKD).

The pH of the pulp suspensions was about 7.0 (±0.5).

When starch was applied between the top and mid ply, the applied amount was about 2 g/m$^2$, based on dry weight.

Example 1A and 1B (Comparative Example)

A 2-ply 120 g/m$^2$ linerboard was prepared according to the 2-ply liner preparation method described above using 100% UBKP in both top and back ply as set out in Table 1. The 2-ply structure was made with starch between the plies (1A) and without starch between the plies (1B). The liners were analyzed and the results are presented in Table 2.

Example 2A and 2 B

In this example, the back-ply comprised 90% of NSSC pulp as set out in Table 1. The 2-ply structure was made with starch between the plies (2A) and without starch between the plies (2B). The liners were analyzed and the results are presented in Table 2. The trials show that many mechanical properties can be maintained or improved especially Scott Bond and SCT Index GEOM.

Example 3A and 3B

In this case, the NSSC content in the top ply was increased to 25%, and NSSC content in the back ply was increased to 95% as set out in Table 1. The 2-ply structure was made with starch between the plies (3A) and without starch between the plies (3B). The liners were analyzed and the results are presented in Table 2.

Example 4A and 4B (Comparative Example)

In this example, the 2-ply structure was prepared with high content of NSSC (50%) in the first ply, whereas the back ply contained 95% NSSC as set out in Table 1. The 2-ply structure was made with starch between the plies (4A) and without starch between the plies (4B). The liners were analyzed and the results are presented in Table 2.

TABLE 1

| Experimental setup | | | | | | | | | |
|---|---|---|---|---|---|---|---|---|---|
| | Unit | 1A | 1B | 2A | 2B | 3A | 3B | 4A | 4B |
| | | 2-ply | 2-ply | 2-ply | 2-ply | 2-ply | 2-ply | 2-ply | 2-ply |
| Grammage, total | $g/m^2$ | 120 | 120 | 120 | 120 | 120 | 120 | 120 | 120 |
| Grammage, top-ply | $g/m^2$ | 40 | 40 | 40 | 40 | 40 | 40 | 40 | 40 |
| Grammade, back-ply | $g/m^2$ | 80 | 80 | 80 | 80 | 80 | 80 | 80 | 80 |
| Pulp Composition top-ply | | | | | | | | | |
| UBKP | | 100 | 100 | 100 | 100 | 75 | 75 | 50 | 50 |
| NSSC | | | | | | 25 | 25 | 50 | 50 |
| Pulp Composition back-ply | | | | | | | | | |
| UBKP | | 100 | 100 | 10 | 10 | 5 | 5 | 5 | 5 |
| NSSC | | | | 90 | 90 | 95 | 95 | 95 | 95 |
| Spray starch | $g/m^2$ | 2 | 0 | 2 | 0 | 2 | 0 | 2 | 0 |

TABLE 2

| Physical properties of the samples | | | | | | | | | |
|---|---|---|---|---|---|---|---|---|---|
| | Unit | 1A | 1B | 2A | 2B | 3A | 3B | 4A | 4B |
| | | 2-ply | 2-ply | 2-ply | 2-ply | 2-ply | 2-ply | 2-ply | 2-ply |
| Brightness C/2° + UV, ts | % | 15.56 | 15.36 | 17.05 | 17 | 19.55 | 19.47 | 23.6 | 24.21 |
| Brightness C/2° + UV, bs | % | 15.9 | 15.66 | 37.26 | 37.32 | 38.47 | 39.17 | 38.78 | 39.31 |
| L* C/2° + UV, ts | | 59.3 | 58.94 | 63.2 | 63.46 | 66.24 | 65.97 | 69.83 | 70.27 |
| L* C/2° + UV, bs | | 59.3 | 58.95 | 77.31 | 77.48 | 78.25 | 78.63 | 78.61 | 78.93 |
| a* C/2° + UV, ts | | 7.61 | 7.64 | 8.22 | 8.07 | 7.31 | 7.41 | 6.11 | 5.99 |
| a* C/2° + UV, bs | | 7.44 | 7.49 | 2.33 | 2.28 | 2.21 | 1.99 | 2.3 | 2.2 |
| b* C/2° + UV, ts | | 22.74 | 22.6 | 26.19 | 26.75 | 26.28 | 25.95 | 24.96 | 24.66 |
| b* C/2° + UV, bs | | 21.98 | 21.9 | 17.46 | 17.68 | 17.54 | 17.32 | 17.77 | 17.67 |
| Grammage | $g/m^2$ | 123 | 124.2 | 123.1 | 120.4 | 122.9 | 121.7 | 121.7 | 120 |
| Thickness, single sheet | µm | 169 | 169 | 172 | 169 | 175 | 177 | 182 | 177 |
| Density, single sheet | $kg/m^3$ | 726 | 734 | 716 | 711 | 701 | 686 | 669 | 678 |
| Bulk, single sheet | $cm^3/g$ | 1.38 | 1.36 | 1.4 | 1.41 | 1.43 | 1.46 | 1.49 | 1.47 |
| Grammage top layer | g/m2 | | 38.9 | | 34.2 | | | | |
| Grammage bottom layer | g/m2 | | 89.6 | | 88.3 | | | | |
| | | | 128.5 | | 122.5 | | | | |
| Air permeability G-H | µm/Pas | 1.226 | 1.359 | 1.928 | 2.442 | 2.442 | 2.828 | 2.769 | 4.01 |
| Air resistance G-H | s/100 ml | 104.4 | 94.22 | 66.38 | 52.42 | 52.42 | 45.26 | 46.22 | 31.92 |
| Bendtsen roughness, ts | ml/min | 779 | 696 | 637 | 479 | 516 | 758 | 648 | 922 |
| Bendtsen roughness, bs | ml/min | 1353 | 1324 | 1533 | 1449 | 1441 | 1495 | 1332 | 1363 |
| Moisture content 50% rh | % | 7.88 | 7.83 | 7.06 | 7.55 | 7.29 | 7.01 | 7.21 | 7.11 |
| Scott-Bond, md | $J/m^2$ | 479 | 396 | 477 | 306 | 525 | 314 | 510 | 297 |
| Tensile strength, md | kN/m | 13.2 | 12.92 | 12.53 | 11.78 | 12.34 | 11.59 | 11.98 | 11.78 |
| Tensile strength, cd | kN/m | 5.85 | 5.8 | 5.95 | 5.68 | 5.9 | 5.76 | 5.83 | 5.73 |
| Tensile index, md | Nm/g | 107.28 | 104.01 | 101.83 | 97.85 | 100.34 | 95.21 | 98.45 | 98.12 |
| Tensile index, cd | Nm/g | 47.54 | 46.67 | 48.33 | 47.21 | 48 | 47.33 | 47.94 | 47.75 |
| Tensile index geom. | | 71.4 | 69.7 | 70.2 | 68.0 | 69.4 | 67.1 | 68.7 | 68.4 |
| Tensile strength md/cd | | 2.26 | 2.23 | 2.11 | 2.07 | 2.09 | 2.01 | 2.05 | 2.05 |
| Stretch, md | % | 2.1 | 2 | 1.7 | 1.7 | 1.7 | 1.5 | 1.6 | 1.6 |
| Stretch, cd | % | 6.8 | 6.9 | 5.2 | 4.9 | 4.8 | 4.6 | 4.7 | 4.6 |
| Tensile stiffness, md | kN/m | 1292.6 | 1302 | 1273.2 | 1241.8 | 1262.9 | 1276.7 | 1257.1 | 1259.4 |
| Tensile stiffness, cd | kN/m | 485.3 | 478.8 | 515.3 | 503.8 | 532.1 | 531.6 | 530.4 | 530.8 |
| Tensile stiffness index, md | kNm/g | 10.51 | 10.48 | 10.34 | 10.31 | 10.27 | 10.49 | 10.33 | 10.49 |
| Tensile stiffness index, cd | kNm/g | 3.95 | 3.86 | 4.19 | 4.18 | 4.33 | 4.37 | 4.36 | 4.42 |
| Tensile stiffness GM | | 6.44 | 6.36 | 6.58 | 6.56 | 6.67 | 6.77 | 6.71 | 6.81 |
| E-modulus, md | MPa | 7630 | 7698 | 7409 | 7336 | 7203 | 7196 | 6912 | 7117 |
| E-modulus, cd | MPa | 2865 | 2831 | 2999 | 2976 | 3035 | 2996 | 2917 | 2999 |
| TEA, md | $J/m^2$ | 174.7 | 164.37 | 133.7 | 120.44 | 128.51 | 107.36 | 120.08 | 114.46 |
| TEA, cd | $J/m^2$ | 284.53 | 289.79 | 221.65 | 201.93 | 202.62 | 190.02 | 195.84 | 188.27 |
| TEA index, md | J/g | 1.42 | 1.323 | 1.086 | 1 | 1.045 | 0.882 | 0.987 | 0.954 |
| TEA index, cd | J/g | 2.313 | 2.333 | 1.801 | 1.677 | 1.648 | 1.561 | 1.609 | 1.568 |
| TEA index geom. | | 1.81 | 1.76 | 1.40 | 1.29 | 1.31 | 1.17 | 1.26 | 1.22 |
| Fracture toughness, md | J/m | 2.027 | 2.14 | 1.129 | 1.119 | 1.096 | 1.099 | 1.04 | 1.017 |
| Fracture toughness, cd | J/m | 2.011 | 1.807 | 1.229 | 1.255 | 1.144 | 1.111 | 1.05 | 1.033 |
| Fracture toughness index, md | Jm/kg | 16.48 | 17.23 | 9.17 | 9.29 | 8.92 | 9.03 | 8.55 | 8.47 |
| Fracture toughness index, cd | Jm/kg | 16.35 | 14.55 | 9.98 | 10.42 | 9.31 | 9.13 | 8.63 | 8.61 |
| Fracture toughness index, geom | | 16.41 | 15.83 | 9.57 | 9.84 | 9.11 | 9.08 | 8.59 | 8.54 |

TABLE 2-continued

| Physical properties of the samples | | | | | | | | | |
|---|---|---|---|---|---|---|---|---|---|
| | Unit | 1A | 1B | 2A | 2B | 3A | 3B | 4A | 4B |
| Tearing resistance, md | mN | 1250 | 1256 | 853 | 913 | 770 | 792 | 719 | 732 |
| Tearing resistance, cd | mN | 1473 | 1544 | 987 | 1000 | 945 | 914 | 859 | 850 |
| Tear index, md | $mNm^2/g$ | 10.2 | 10.1 | 6.9 | 7.6 | 6.3 | 6.5 | 5.9 | 6.1 |
| Tear index, cd | $mNm^2/g$ | 12 | 12.4 | 8 | 8.3 | 7.7 | 7.5 | 7.1 | 7.1 |
| SCT, md | kN/m | 4.55 | 4.93 | 5.04 | 4.71 | 5.07 | 4.87 | 4.75 | 4.67 |
| | | 37.0 | 39.7 | 40.9 | 39.1 | 41.3 | 40.0 | 39.0 | 38.9 |
| SCT, cd | kN/m | 2.76 | 2.59 | 3.25 | 2.95 | 3.01 | 3.03 | 2.99 | 2.92 |
| | | 22.4 | 20.9 | 26.4 | 24.5 | 24.5 | 24.9 | 24.6 | 24.3 |
| SCT, GM | kN/m | 3.54 | 3.57 | 4.04 | 3.72 | 3.9 | 3.84 | 3.77 | 3.7 |
| SCT geom index | | 25.4 | 24.5 | 29.4 | 27.5 | 27.9 | 28.0 | 27.6 | 27.4 |
| RCT, md | N | 246.63 | 253.71 | 288.86 | 265.34 | 275.49 | 269.44 | 259.56 | 256.14 |
| RCT, cd | N | 187.1 | 193.78 | 226.55 | 207.55 | 225.77 | 218.78 | 212.07 | 210.01 |
| RCT kN/m, md | kN/m | 1.62 | 1.66 | 1.9 | 1.74 | 1.81 | 1.77 | 1.7 | 1.68 |
| RCT kN/m, cd | kN/m | 1.23 | 1.27 | 1.49 | 1.36 | 1.48 | 1.44 | 1.39 | 1.38 |
| RCT index, md | kNm/g | 0.0132 | 0.0134 | 0.0154 | 0.0145 | 0.0147 | 0.0145 | 0.014 | 0.014 |
| RCT index, md | Nm/g | 13.17 | 13.37 | 15.43 | 14.45 | 14.73 | 14.54 | 13.97 | 14.00 |
| RCT index, cd | kNm/g | 0.01 | 0.0102 | 0.0121 | 0.0113 | 0.012 | 0.0118 | 0.0114 | 0.0115 |
| RCT index, cd | Nm/g | 10.00 | 10.23 | 12.10 | 11.30 | 12.04 | 11.83 | 11.42 | 11.50 |
| RCT index geom. | | 0.3 | 0.3 | 0.4 | 0.4 | 0.4 | 0.4 | 0.4 | 0.4 |
| IGT-picking, md ts | m/s | 1.66 | | 1.09 | | 1.23 | | 1.51 | |
| Burst index | $kPam^2/g$ | 4.16 | 3.94 | 3.64 | 3.37 | 3.44 | 3.46 | 3.61 | 3.27 |
| Bursting strength | kPa | 512 | 489 | 448 | 405 | 423 | 421 | 439 | 393 |

Unless otherwise stated, the physical properties discussed in the present disclosure are determined according to the following standards:

| | |
|---|---|
| Brightness C/2° +UV | ISO 2470-1 |
| L* C/2° +UV | ISO 5631-1 |
| a* C/2° +UV | ISO 5631-1 |
| b* C/2° +UV | ISO 5631-1 |
| Grammage | ISO 536 |
| Thickness, single sheet | ISO 534 |
| Bulk, single sheet | ISO 534 |
| Air permeability G-H | ISO 5636-5 |
| Cobb 30 s | ISO 535 |
| Moisture content 50% rh | ISO 287 |
| Scott-Bond | TAPPI T569 |
| Tensile strength | ISO 1924-3 |
| Tensile index | ISO 1924-3 |
| Tensile strength md/cd | ISO 1924-3 |
| Stretch | ISO 1924-3 |
| Tensile stiffness | ISO 1924-3 |
| Tensile stiffness index | ISO 1924-3 |
| E-modulus | ISO 1924-3 |
| TEA | ISO 1924-3 |
| TEA index | ISO 1924-3 |
| TEA index | ISO 1924-3 |
| Fracture toughness | ISO/TS 17958 |
| Fracture toughness index | ISO/TS 17958 |
| Tearing resistance | ISO 1974 |
| Tear index | ISO 1974 |
| SCT | ISO 9895 |
| SCT index | ISO 9895 |
| RCT | ISO 12192 |
| RCT index | ISO 12192 |
| Burst index | ISO 2759 |
| Bursting strength | ISO 2759 |

Unless otherwise stated, then the standard method can be applied for determining physical and mechanical properties in both cross direction (cd) and machine direction (md)

The invention claimed is:

1. A multi-ply liner for use in corrugated board, said multi-ply liner comprising:

a first ply, wherein said first ply comprises at least 70 wt % unbleached kraft pulp and between 5-30 wt % neutral sulfite semi chemical (NSSC) pulp based on a dry weight;

a second ply, wherein said second ply comprises at least 50 wt % NSSC pulp and between 5-50 wt % unbleached kraft pulp based on a dry weight; and, a third ply, wherein said third ply comprises at least 70 wt % unbleached kraft pulp and between 5-30 wt % neutral sulfite semi chemical (NSSC) pulp based on a dry weight, wherein the multi-ply liner comprises more than 50 wt % neutral sulfite semi chemical (NSSC) pulp based on dry weight, and wherein the second ply is in between the first ply and the third ply.

2. The multi-ply liner according to claim 1, wherein said first ply comprises at least 75 wt % unbleached kraft pulp based on the dry weight.

3. The multi-ply liner according to claim 1, wherein said first ply comprises between 5-20 wt % NSSC pulp based on the dry weight.

4. The multi-ply liner according to claim 1, wherein said second ply comprises at least 60 wt % NSSC pulp based on the dry weight.

5. The multi-ply liner according to claim 1, wherein at least 30% of the second ply comprises recycled cellulose fibers.

6. The multi-ply liner according to claim 1, wherein a grammage of each of the first ply and the second ply is in a range of 20-150 $g/m^2$.

7. The multi-ply liner according to claim 1, wherein an average particle size of the NSSC pulp in the first ply is lower than an average particle size of the NSSC pulp in the second ply.

8. The multi-ply liner according to claim 1, wherein said multi-ply liner further comprises an internal sizing agent.

9. The multi-ply liner according to claim 1, wherein at least one side of said multi-ply liner has a Cobb 30 s value below 30, as determined according to standard ISO 535.

10. The multi-ply liner according to claim 1, wherein said multi-ply liner has an equilibrium moisture content (EMC) of less than 10 wt %, at 50% RH, as determined according to standard ISO 287.

11. A corrugated board comprising:

the multi-ply liner according to claim 1, and a fluting.

12. A method for manufacturing a multi-ply liner for use in corrugated board, the method comprising the steps of:

a) forming a first web layer from a first pulp suspension and dewatering said first web layer to obtain a first ply;

b) forming a second web layer from a second pulp suspension and dewatering said second web layer to obtain a second ply on the first ply;

wherein said first pulp suspension comprises at least 70 wt % unbleached kraft pulp and between 5-30 wt % neutral sulfite semi chemical (NSSC) pulp based on a dry weight, and wherein said second pulp suspension comprises at least 50 wt % NSSC pulp and between 5-50 wt % unbleached kraft pulp based on a dry weight;

c) forming a third ply, wherein said third ply comprises at least 70 wt % unbleached kraft pulp and between 5-30 wt % neutral sulfite semi chemical (NSSC) pulp based on a dry weight, wherein the second ply is in between the first ply and the third ply, wherein the first ply, the second ply, and the third play are dried to form a multi-ply liner comprising at least 50 wt % neutral sulfite semi chemical (NSSC) pulp based on dry weight.

* * * * *